US005381485A

United States Patent [19]

Elliott

[11] Patent Number: 5,381,485

[45] Date of Patent: Jan. 10, 1995

[54] ACTIVE SOUND CONTROL SYSTEMS AND SOUND REPRODUCTION SYSTEMS

[75] Inventor: Stephen J. Elliott, Winchester, England

[73] Assignee: Adaptive Control Limited, England

[21] Appl. No.: 113,150

[22] Filed: Aug. 27, 1993

[30] Foreign Application Priority Data

Aug. 29, 1992 [GB] United Kingdom ..... 9218465
Oct. 5, 1992 [GB] United Kingdom ..... 9220879

[51] Int. Cl.[6] ..... G10K 11/16
[52] U.S. Cl. ..... 381/71
[58] Field of Search ..... 381/71, 94

[56] References Cited

U.S. PATENT DOCUMENTS 5,133,017 7/1992 Cain et al. ..... 381/71
5,267,320 11/1993 Fukumizu ..... 381/71

FOREIGN PATENT DOCUMENTS 1541121 2/1979 United Kingdom .
WO88/02912 4/1988 WIPO .
WO89/11841 11/1989 WIPO .
WO92/08223 5/1992 WIPO .

*Primary Examiner*—Forester W. Isen
*Attorney, Agent, or Firm*—Quarles & Brady

[57] ABSTRACT

With reference to FIG. 1, an active sound control system comprises a loudspeaker LS having an input qs and operable to generate sound waves for interference with unwanted sound so as to produce a region close to the user of the system in which the perceived sound is substantially reduced. A monitoring microphone ro is positioned closer to the loudspeaker LS than to the region of sound reduction. Loudspeaker control means for controlling the input qs to the loudspeaker LS operate to energise the loudspeaker such that the sound waves emitted by the loudspeaker substantially cancel the unwanted sound waves in said region. The loudspeaker control means includes a signal processing means (FIG. 3) arranged to simulate a microphone output that would be obtained if that microphone, instead of being positioned closer to the loudspeaker LS than the user, were to be positioned in a notional position ra relatively close to the user. The resulting simulated or virtual microphone output is then used to control the signal fed to the loudspeaker input qs.

7 Claims, 5 Drawing Sheets

ACTIVE SOUND CONTROL SYSTEMS AND SOUND REPRODUCTION SYSTEMS

Figure 1:
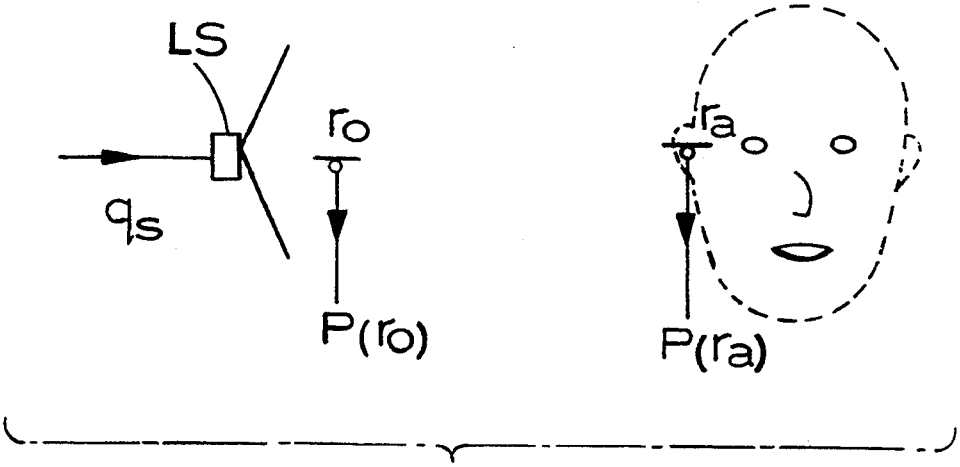

This invention relates to a method and apparatus for the active control of sound, and also to sound reproduction systems.

Olson and May (The Journal of Acoustical Society of America—Vol. 25, Number 6, November 1953) proposed various arrangements for reducing the perceived level of sound by the use of one or more loudspeakers having an input which is a function of the sound waves to be negated. One of the arrangements they described employed a loudspeaker and microphone closely adjacent to the head of a person located in a noisy environment, such as in an aircraft or car, or operating a machine tool. It was realised that such an arrangement could provide a reduction in the sound level over a limited space, and this was termed a 'spot-type sound reducer', indicative of the fact that the system provides sound reduction over only a relatively local volume.

Since the objective is to reduce the perceived level of unwanted sound at the ears of a listener, it would appear that the best control of such a system could be achieved by placing the microphone next to the ears, and several systems have been tried which require the user to wear a headset, the ear pieces of which contain both a microphone and a loudspeaker. Such arrangements are acceptable in some situations as, for example, a pilot who needs to wear a headset for other purposes.

A recent arrangement which does not use a headset is disclosed in Specification No. WO 89/11841 of Ziegler, but microphones are positioned as close as possible to the ears and we consider that this would be unsettling for the user.

We have conducted some preliminary work on measuring the dependence of the volume of the region of substantial sound reduction on the spacing of the microphone from the loudspeaker, and initial indications are that the volume of said sound reduction region increases with increased spacing up to a limit. Essentially it is still desirable from a theoretical standpoint to have the microphones at the ears of the person experiencing the unwanted sound field.

Systems have also been proposed for controlling the perceived sound level throughout a large volume such as throughout a large room. Such systems require a large number of microphones and loudspeakers which both have to be positioned in dependence upon the position of the sound sources and the character of the room. By making extensive measurements on the sound field in the room it is possible to devise a system which does provide a substantial reduction in the perceived level of sound at most locations in the room. We have discussed such a system in Specification No. WO 88/02912.

One aim of the present invention is to provide a system which is capable of producing a relatively large volume of sound reduction on a local basis but without the need for a microphone relatively close to the ear of the user.

According to one aspect of the invention, an active sound control system comprises a loudspeaker for generating sound waves for interference with unwanted sound to produce a region close to the user in which the perceived sound is substantially reduced, a microphone positioned closer to the loudspeaker than the position of the required region of sound reduction, loudspeaker control means for controlling the input to the loudspeaker and operating to energise the loudspeaker such that the sound waves emitted by the loudspeaker substantially cancel the unwanted sound waves in said region close to the user, in which the loudspeaker control means includes a signal processing means arranged to simulate a microphone output that would be obtained if the microphone, instead of being positioned close to the loudspeaker, were to be positioned in a notional position relatively close to the user, the resulting simulated microphone output being used to control the signal fed to the loudspeaker.

The action of the system can be understood by expressing the total complex harmonic response of a microphone at position ro and an apparent or virtual microphone at position ra as the superposition of the contributions from the primary (unwanted) sources ($p_p(ro)$ and $p_p(ra)$ respectively) and the contributions due to the effect of the secondary (control) loudspeaker fed by a signal $q_s$, so that:

$$p(ro)=p_p(ro)+Z(ro)q_s$$

and $$p(ra)=p_p(ra)+Z(ra)q_s$$

where Z(ro) is the electrical transfer response at the frequency of interest between the loudspeaker and the monitor microphone, at ro, and Z(ra) is the electrical transfer response between the loudspeaker and the apparent microphone, at ra.

If the wavelength of the sound is large compared to the microphone separation distance (ra-ro) then $p_p(ra)\cong p_p(ro)$. A good estimate of the response of the apparent microphone, $\hat{p}(ra)$, can then be obtained from response of the true microphone using the equation:

$$\hat{p}(ra)=p(ro)+[Z(ra)-Z(ro)]q_s\cong p(ra)$$

The signal processing means is a practical implementation of the above equation.

The signal processing means can thus be arranged to take account of the difference in the electrical transfer responses between the loudspeaker and a single microphone, when the microphone is positioned respectively at the 'actual' microphone position ro and at the 'notional' microphone position ra, the difference Z(ra)−Z(ro) in the two electrical transfer responses being determined conveniently by tests which comprise positioning the microphone at the actual and notional positions sequentially, while driving the loudspeaker and measuring the two outputs to determine the transfer responses Z(ra) and Z(ro). The output of the microphone p(ro) is conditioned in the controller by the difference between the transfer responses Z(ra)−Z(ro) to derive a notional response $\hat{p}(ra)$ and this notional response is used to control the loudspeaker.

In practice the transfer response from the electrical input driving the loudspeaker, to the electrical output of the microphone may be modelled using an electronic filter, which may be digital if these signals are sampled in a digital control system. If the sound field to be cancelled has a sinusoidal waveform, these electrical filters need only model the amplitude and phase characteristics of the transfer responses at the single excitation frequency using, for example, a two-coefficient digital FIR filter. If the sound field to be cancelled has a number of frequency components, or if the excitation frequency is changing, or if the excitation waveform is broad band random, then the electrical filters will be required to model the amplitude and phase characteristics of the transfer response over a range of frequencies using, for example, a digital FIR filter with many coefficients.

The notional response $\hat{p}(ra)$ derived from the physical response p(ro) is preferably used as a feedback signal for adjusting the filter coefficient/s of an adaptive filter W which generates a loudspeaker input signal in response to a reference signal derived from the source of the unwanted sound.

According to a second aspect of the invention, a method of creating a region in which the sound waves from a sound source are substantially cancelled or reduced comprises during a setting-up stage measuring the difference in the outputs of a test microphone at the position of the required region of sound reduction, p(ra), and the output of the closely-spaced control microphone after it has been passed through a signal processing means, $\hat{p}(ra)$, and then using said measurements to determine the characteristics of the signal processing means for use in a sound control system in accordance with the first aspect of the invention.

The response of the electrical filter in the signal processing circuit representing the difference in the electrical transfer responses $(Z(ra)-Z(ro)=\Delta Z)$, for example, $(\Delta Z)$ can then be adjusted to minimise this difference signal and thus ensure that $\hat{p}(ra)$ is as close to p(ra) as possible. If the filter in the signal processing circuit is a digital FIR filter, one way in which adjustment can be achieved is by adapting the coefficients of the filter according to the LMS algorithm described, for example, by B. Widrow and S. Sterns 'Adaptive Signal Processing' (1985, Prentice Hall), chapter 9.

During an operative stage the output from the closely-positioned microphone (p(ro)) is then taken and conditioned by the filter $\Delta Z$ determined in the setting-up stage to produce a notional microphone output which corresponds to the notional positioning of the microphone at the more remote position, and using the notional microphone output as a control signal for adjusting the output of the loudspeaker being driven in response to a reference signal derived from a source of unwanted sound.

A third aspect of the invention relates to a sound reproduction system which is an inventive modification or improvement upon the systems described in specification WO 90/00851 of Nelson, Elliott and Stothers. In that specification various sound reproduction systems are described which comprise means for employing a measurement of the reproduced field so arranged as to enhance the accuracy of the reproduction system. In a stereophonic sound reproduction system a plurality of speaker channels is employed and each of the channels includes a digital filter the characteristics of which are adjusted or set in response to measurements of the reproduced field. Such measurements are made by placing microphones at certain positions in the reproduced field.

The third aspect of the present invention is, in particular, concerned with placing microphones at positions in the reproduced field that are remote from the positions at which the best reproduction is desired. Ideally one would wish to put the microphones at the positions of the listener's ears such that the digital filters are adjusted to provide the best reproduction at those positions. However, this would be intrusive. By using the virtual microphone effect that has been described above in relation to an active noise control system, it should be possible to place the microphones at positions remote from the listener's ears yet adjust the adaptive filters to produce the best regions of reproduction at the listener's ears.

According to the third aspect of the invention a sound reproduction system comprises microphone means for providing a measurement of the reproduced field and an adaptive filter in a speaker channel, the adaptive filter being adjusted or set in response to said measurement, the microphone means being positioned in said field remote from a listener location, and including a signal processing means arranged to simulate a microphone output that would be obtained if the microphone, instead of being positioned at the remote location, were to be positioned in a notional position relatively close to the listener location, the resulting simulated microphone output being used to control the signal fed to the adaptive filter.

Directional microphones, such as cardiods, may advantageously be employed in systems in accordance with the various aspects of the invention.

Figure 2:
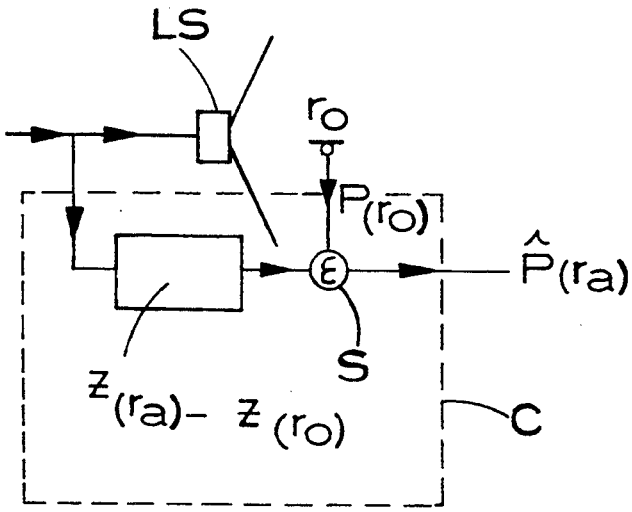
Figure 3:
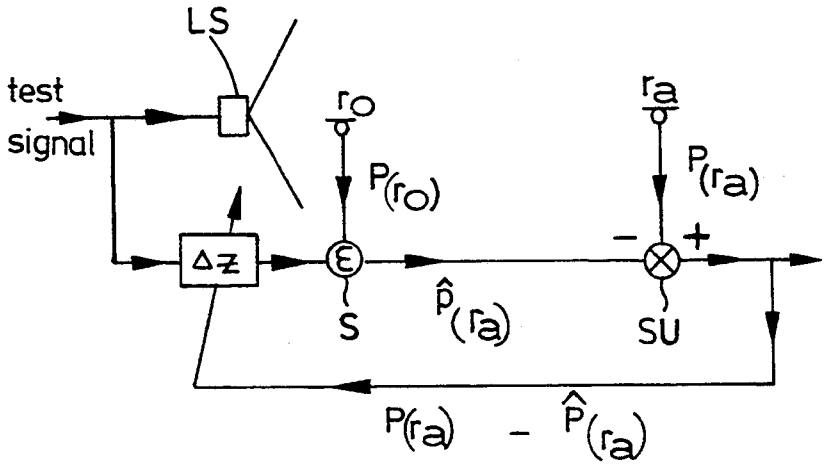
Figure 4A:
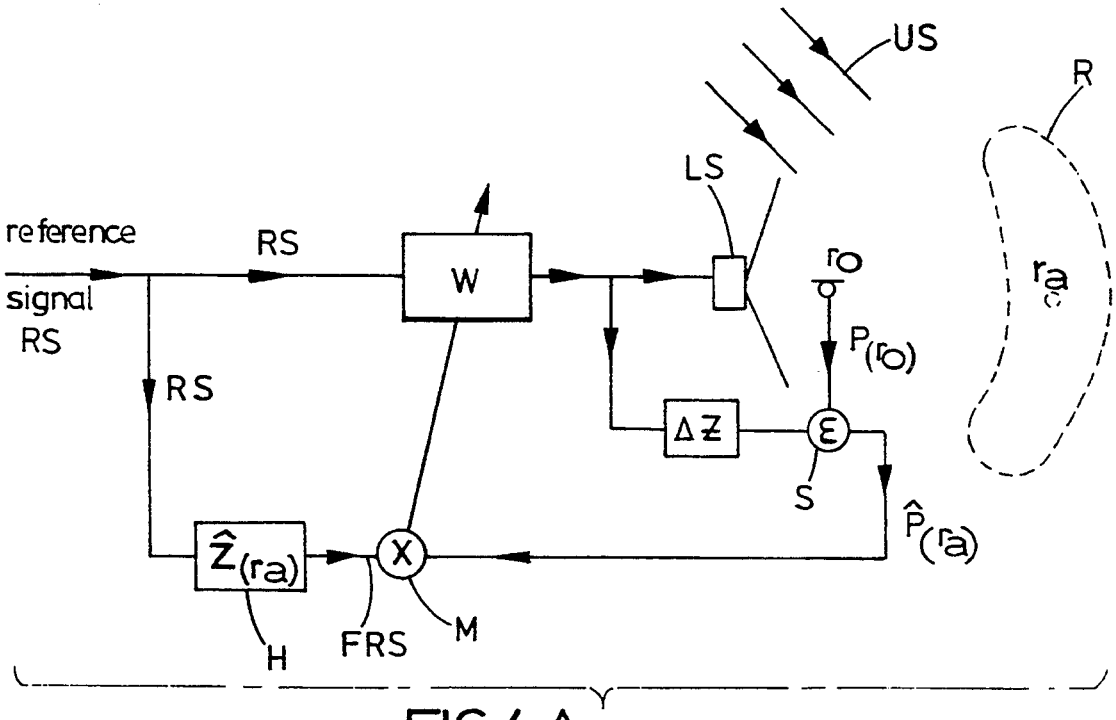
Figure 5:
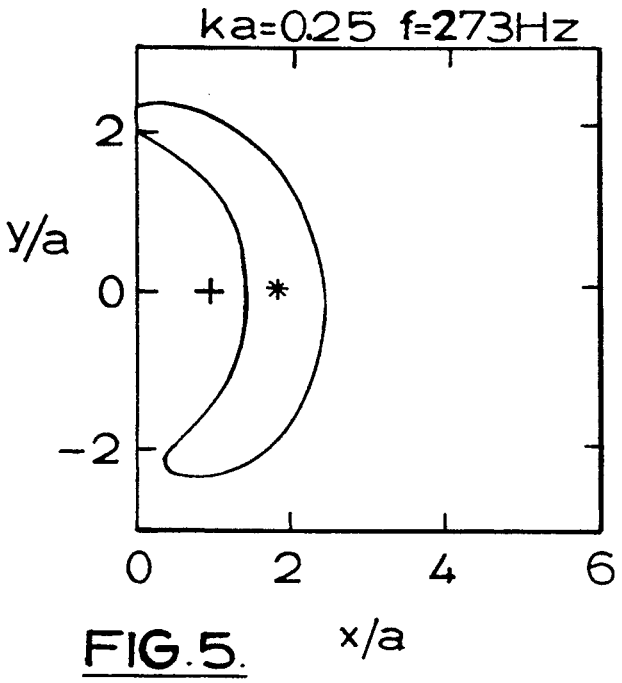
Figure 4B:
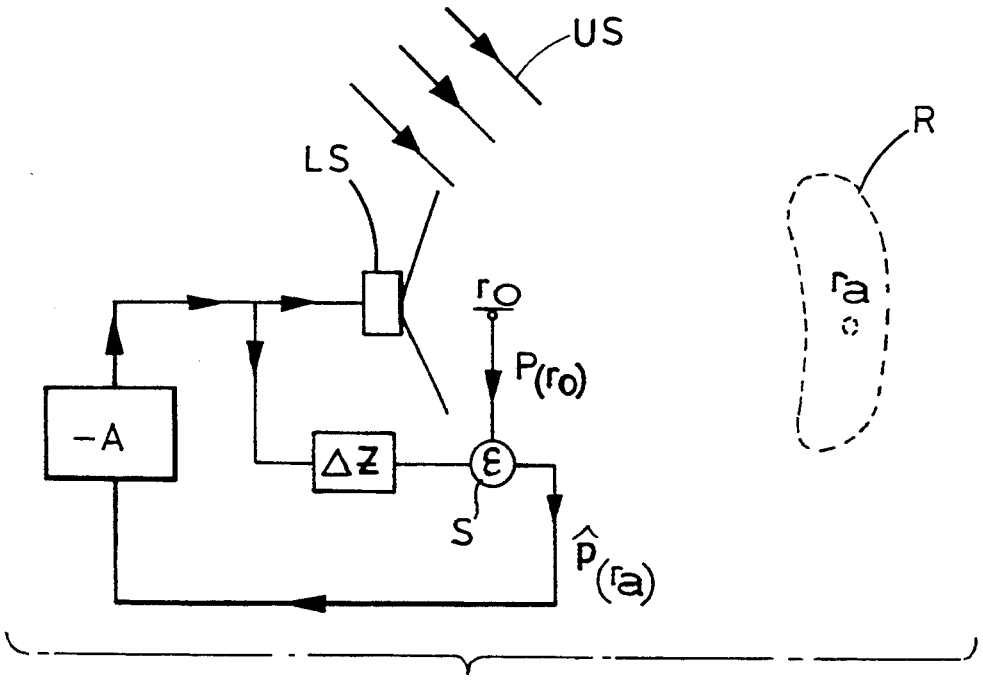
Figure 6:
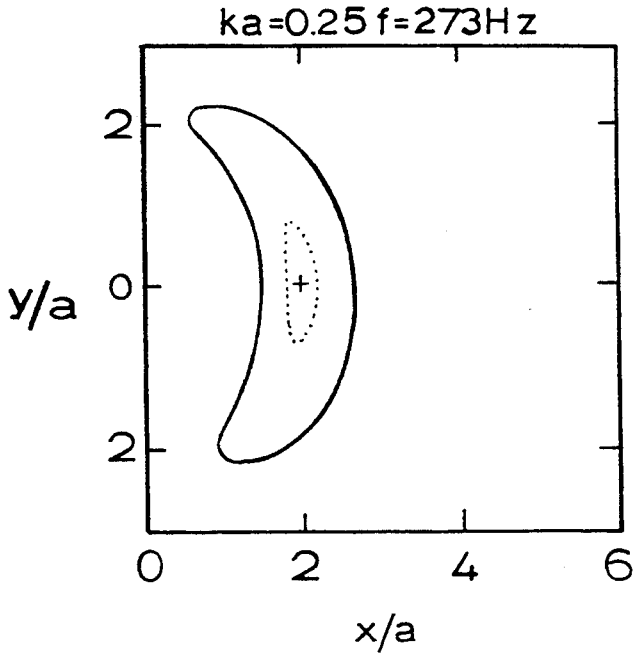
Figure 7:
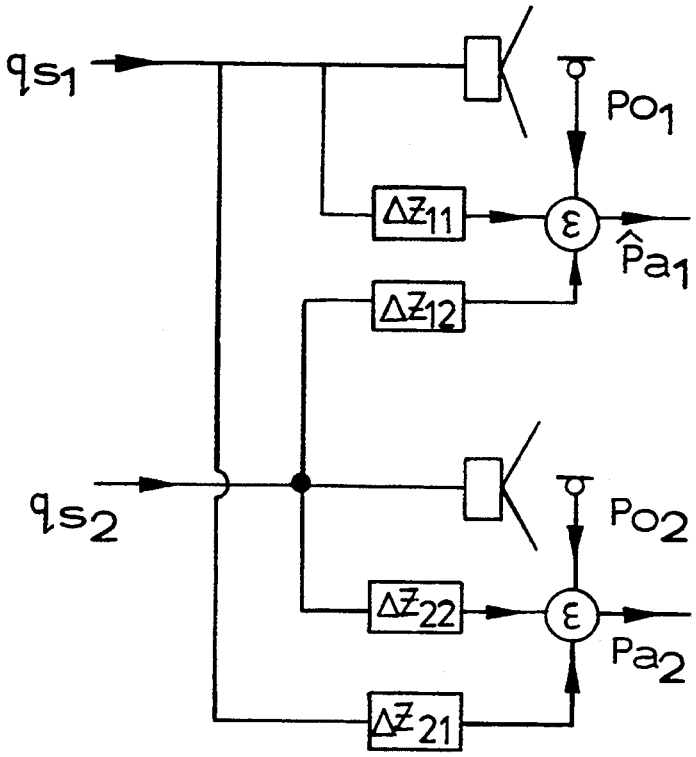

The invention will now be further described, by way of example only, with reference to the accompanying drawings, in which:

FIG. 1 is a diagram showing actual microphone position ro and apparent microphone position ra relative to a loudspeaker LS, FIG. 2 is a diagram showing the generation of an apparent microphone output from an actual microphone output, FIG. 3 is a diagram showing the training set up for training the filter $\Delta Z$ in the converter in accordance with the invention, FIG. 4A is a diagram showing an adaptive sound control system in accordance with the invention employing feedforward control and utilising the trained converter $\Delta Z$ of FIG. 3, FIG. 4B is a diagram showing an adaptive sound control system in accordance with the invention employing feedback control and utilising the trained converter $\Delta Z$ of FIG. 3, FIG. 5 is a plot of the quiet zone according to a computer simulation of the system of FIG. 4, FIG. 6 is a plot, for comparison with FIG. 5, of the quiet zone according to a computer simulation of a system (not in accordance with the invention) utilising an error microphone in the centre of the quiet zone, and FIG. 7 shows a two-channel active sound control system in accordance with the invention.

Referring to FIG. 1, this shows a loudspeaker LS and two microphone positions ro and ra. The first microphone position ro is relatively close to the loudspeaker and is the position at which the microphone is to be positioned during use of the sound control system to be described. The second microphone position ra is relatively remote from the loudspeaker LS and is in a position at which is would be desirable to place a microphone if it were not for the fact that such a microphone, at that point, would prove intrusive to the person who is to benefit from the sound reduction which results from use of the loudspeaker in a field of unwanted sound.

The second microphone position is indicated as being at the ear of the user in FIG. 1, because this would generally be the ideal position for a microphone to provide a feedback signal for controlling the loudspeaker drive signal $q_s$. The microphone output is denoted p(ro) for a microphone positioned at ro, and p(ra) for the microphone when positioned at ra.

Using the equation for $\hat{p}(ra)$ derived above, then, as indicated in FIG. 2, by introducing a converter C into the output from the microphone position at ro, we can generate an apparent microphone signal $\hat{p}(ra)$ corresponding to the actual microphone signal that would obtain if, instead of positioning the microphone at position ro in FIG. 1, the microphone were to be positioned at position ra. The unit S denotes an electrical summing unit.

In broad terms the invention is to use the apparent microphone signal $\hat{p}(ra)$ as a control signal for adjusting in part the drive signal $q_s$ to the loudspeaker LS. There are various ways in which the signal $\hat{p}(ra)$ may be used, and FIGS. 4A and 4B show two examples.

FIG. 3 shows one set up for initial training of the converter C. Two microphones are positioned at positions ro and ra, and the error signal $p(ra)-\hat{p}(ra)$ produced at the output of the subtraction unit SU is used to drive the compensation filter $\Delta Z$ to the optimum setting. At this setting of the filter $\Delta Z$ the output $\hat{p}(ra)$ of the summing unit S corresponds to the output of a microphone placed at the position ra. Accordingly, it is now possible to dispense with an actual microphone at position ra.

The training procedure also comprises measuring the response $\hat{Z}(ra)$ from the loudspeaker LS to the microphone positioned at ra.

FIG. 4A shows one example of feedforward control, whereas FIG. 4B shows one example of feedback control.

In FIG. 4A the previously trained filter $\Delta Z$ is being used to generate an apparent microphone output $\hat{p}(ra)$ from an actual microphone output p(ro) generated by the microphone placed at ro in response to the output from loudspeaker LS which is attempting to cancel unwanted incoming sound US under the control of an adaptive filter W. Filter W receives a reference signal RS based on the incoming unwanted sound US from a suitable transducer, which is preferably a transducer positioned at the source of the unwanted sound US, for example on an internal combustion engine.

In FIG. 4A the filter coefficients of an adaptive filter W are adjusted in response both to the apparent microphone signal $\hat{p}(ra)$ and in response to the output of a unit H which operates on the reference signal RS with the recorded response $\hat{Z}(ra)$ to provide a filtered signal FRS as required for the filtered-x LMS algorithm, for example, as described by B. Widrow & S. Stears 'Adaptive Signal Processing' (1985, Prentice Hall) chapter 11. An adaptive filter will generally be necessary to cope with changes in amplitude and phase of the incoming unwanted sound over a period of time, although the control filters could be fixed if the sound field was very stable.

The system of FIG. 4A is capable of substantially reducing or cancelling the incoming unwanted sound US in a region R containing the position ra. The region R may conveniently be defined as that region over which the pressure has been reduced by 10 dB.

The invention makes it possible to provide a local control of unwanted sound without the need for the microphone to be positioned immediately adjacent to the user's head.

The loudspeaker LS and microphone at position ro may, for example, be positioned unobtrusively above a passenger seat in the roof of a vehicle, or in the seat of a vehicle, but without the need for protuberances close to the passenger's head.

Some measurements have been taken of the changes in the electrical transfer response between the loudspeaker and the remote, apparent, microphone Z(ra) when a dummy head is moved next to the microphone. With the remote microphone 100 mm away from a 100 mm diameter secondary loudspeaker, Z(ra) changed by 2–3 dB in amplitude and up to 10 degrees in phase as the dummy head was moved next to the microphone. These changes are not enough to prevent the system from working, but would degrade its performance. This problem could be overcome if the system were trained, as in FIG. 3, but with a dummy head positioned at the listener's assumed head position. Alternatively some pre-calculated correction could be added to Z(ra) to account for the likely change due to the presence of the head.

More exotic solutions are also possible, with the listener's head position being remotely sensed by some transducer (e.g. an ultrasonic position sensor) and appropriate adjustments made to the assumed transfer responses based on this information.

In particular, the position of the apparent microphone, ra, could be changed, so that the zone of quiet is always close to the ears of the listener's head in the measured position.

FIG. 4B shows a feedback system like that of Olson and May supra except that instead of positioning the microphone at the position at which a quiet zone is required the microphone is positioned at a virtual microphone position. The inverting amplifier −A may advantageously include stability compensation circuitry.

FIG. 5 shows the results of a computer simulation of the system of FIG. 4A to provide a plot of the quiet zone in which a 10 dB reduction in pressure is achieved. FIG. 5 illustrates contours of the −10 dB average reduction for a piston secondary source in a diffuse primary field using the virtual microphone arrangement. The position of the physical error microphone is one piston radius from the secondary source (+) and that of the virtual microphone is two piston radii away (*). It is observed that the quiet zone is of generally hemispherical shell shape with the thicker central portion of the shell centred on the virtual microphone position (*). It is noted that the actual microphone position (+) is outside the quiet zone.

For comparison purposes, FIG. 6 shows a similar computer simulation of a conventional system in which a quiet zone is generated in response to an actual microphone positioned in the region at which compensation is required. FIG. 6 illustrates contours of the −10 dB average reduction in solid line and a −20 dB average reduction in dotted line for a piston secondary source in a diffuse primary field. The error microphone is two piston radii from the secondary source, on axis (+). It is observed that the quiet zone is again of generally part-spherical shell shape but that the zone of quiet is centred on the physical microphone position (+).

It is also possible to use the inventive technique in a multi-channel active sound control system which could be used, for example, to control the sound field at both ears of a seated user. If the vector of complex outputs from the L microphones at the true locations is denoted $\underline{po}$, which is the superposition of the contributions from the primary source $p_{po}$, and that of M secondary sources $\underline{Zo}\ \underline{q_s}$, where $q_s$ is the vector of signals driving the secondary sources and $\underline{Zo}$ is the matrix of complex electrical transfer responses between each loudspeaker and each microphone, then:

$$\underline{po}=\underline{p_{po}}+Zo\ \underline{q_s}$$

Similarly the outputs from L microphones at a set of apparent locations may be written as:

$$\underline{pa}=\underline{p_{pa}}+Za\ \underline{q_s}$$

where $p_{pa}$ and Za are defined in a similar fashion to $p_{po}$ and Zo. If we now assume that the true and apparent positions are not too far apart compared to an acoustic wavelength, then $p_{po}\cong p_{pa}$ and we can estimate pa from po using the matrix generalisation of the single channel expression derived above:

$$\underline{pa}=\underline{po}+[\underline{Za}-\underline{Zo}]\underline{q_s}\cong\underline{pa}$$

The implementation of this equation for a system with two loudspeakers and two microphones is illustrated in FIG. 7, in which case the matrix of compensating filters has been expressed as:

$$[\underline{Za}-\underline{Zo}]=\begin{bmatrix}\Delta Z_{11}\Delta Z_{12}\\ \Delta Z_{21}\Delta Z_{22}\end{bmatrix}$$

If there are many channels, the signal processing required for an exact implementation of this multi-channel algorithm will become considerable. Under these conditions, the elements of the matrix $[\underline{Z}a-\underline{Z}o]$ which represent only weak coupling between well-spaced loudspeakers and microphones can be set to zero, which reduces the complexity of the system. If the apparent microphone locations are closer to their corresponding loudspeaker than to any other loudspeaker, it may be sufficient to use a diagonal approximation to $[\underline{Z}a-\underline{Z}o]$ in which case the system reverts to a collection of single channel systems.

I claim:

1. An active sound control system comprising a loudspeaker having an input and operable to generate sound waves for interference with unwanted sound to produce a region close to the user of the system in which the sound perceived by the user is substantially reduced, a microphone positioned at a position ro closer to the loudspeaker than to said region of sound reduction, loudspeaker control means for controlling said input to the loudspeaker and operable to energize the loudspeaker such that the sound waves emitted by the loudspeaker substantially cancel the unwanted sound waves in said region, the loudspeaker control means including signal processing means arranged to simulate a microphone output that would be obtainable if the microphone, instead of being positioned closer to the loudspeaker, as aforesaid, were to be positioned in a notional position ra relatively closer to the user, the simulated microphone output being used to control said loudspeaker input, the complex response of the notional position microphone, $\hat{p}(ra)$, at the frequency of interest, being obtained from the responses of the microphone at said position ro having an output p(ro) using an implementation of the equation:

$$\hat{p}(ra)=p(ro)+[Z(ra)-Z(ro)]q_s$$

where Z(ro) is the electrical transfer response at the frequency of interest between the loudspeaker and the microphone at the position ro, Z(ra) is the electrical transfer response between the loudspeaker and the notional position microphone, at the position ra, and $q_s$ is the signal driving the loudspeaker.

2. A sound control system as claimed in claim 1, having an adaptive filter W, in which the notional response $\hat{p}(ra)$ derived from the physical response p(ro) is used as a feedback signal for adjusting the filter coefficient of said adaptive filter W which generates a loudspeaker input signal in response to a reference signal derived from the source of the unwanted sound.

3. A sound control system as claimed in claim 1, having an inverting amplifier, in which the notional response $\hat{p}(ra)$ derived from the physical response p(ro) is used as a feedback signal which is employed via said inverting amplifier to generate a loudspeaker input signal.

4. A sound control system as claimed in claim 1, including signal compensation means providing a compensation signal based upon measurements of the effect on the sound field of a dummy head positioned at the intended user position.

5. A sound control system as claimed in claim 1, including head position sensing means so arranged as, in use, to sense remotely the position of a listener's head, and in which the signal processing means comprises adjustment means responsive to the output of the position sensing means to adjust the signal fed to the loudspeaker so as to displace said region of reduced perceived sound to compensate at least in part for displacements of the head.

6. A method of creating a region in which the sound waves from a sound source are at least substantially reduced, comprising during a setting-up stage measuring the difference in the outputs of a test microphone at the position of the required region of sound reduction, p(ra), and the output of a control microphone, located in a second position, after it has been passed through a signal processing means, $\hat{p}(ra)$, and then using said measurements to determine the characteristics of signal processing means for use in a sound control system comprising a loudspeaker having an input and operable to generate sound waves for interference with unwanted sound to produce a region close to the user of the system in which the sound perceived by the user is substantially reduced, a microphone positioned at a position ro closer to the loudspeaker than to said region of sound reduction, loudspeaker control means for controlling said input to the loudspeaker and operable to energize the loudspeaker such that the sound waves emitted by the loudspeaker substantially cancel the unwanted sound waves in said region, the loudspeaker control means including signal processing means arranged to simulate a microphone output that would be obtainable if the microphone, instead of being positioned closer to the loudspeaker, as aforesaid, were to be positioned in a notional position ra relatively closer to the user, the simulated microphone output being used to control said loudspeaker input, the complex response of the or notional position microphone, $\hat{p}(ra)$, at the frequency of interest, being obtained from the responses of the microphone at said position ro having an output p(ro) using an implementation of the equation:

$$\hat{p}(ra)=p(ro)+[Z(ra)-Z(ro)]q_s$$

where Z(ro) is the electrical transfer response at the frequency of interest between the loudspeaker and the microphone at the position ro, Z(ra) is the electrical transfer response between the loudspeaker and the notional position microphone, at the position ra, and $q_s$ is the signal driving the loudspeaker.

7. A sound reproduction system comprising microphone means for providing a measurement of the reproduced field, a loudspeaker channel, and an adaptive filter in the loudspeaker channel, the adaptive filter being responsive to said measurement, the microphone means being positioned in a position ro in a field remote from a listener location, and including a signal processing means arranged to simulate a microphone output that would be obtained if the microphone, instead of being positioned at the remote location, were to be positioned in a notional position ra relatively closer to the listener location than said position ro, the resulting simulated microphone output being used to control the signal fed to the adaptive filter, the complex response of the notional position microphone, $\hat{p}$(ra), at the frequency of interest, being obtained from the response of the microphone means at said position ro having an output p(ro) using an implementation of the equation:

$$\hat{p}(ra)=p(ro)+[Z(ra)-Z(ro)]q_s$$

where Z(ro) is the electrical transfer response at the frequency of interest between the loudspeaker of the loudspeaker channel, and the means at the position ro, Z(ra) is the electrical transfer response between the loudspeaker and the notional position microphone at the position ra, and $q_s$ is the signal driving the loudspeaker.

* * * * *